US006402137B1

(12) United States Patent
Gunschera

(10) Patent No.: US 6,402,137 B1
(45) Date of Patent: Jun. 11, 2002

(54) CONVEYOR CHAIN FOR A GRIPPER SYSTEM-BEARING CHAIN CONVEYOR OF A PRINTING PRESS

(75) Inventor: Frank Gunschera, Nussloch (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/206,993

(22) Filed: Dec. 7, 1998

(30) Foreign Application Priority Data

Dec. 5, 1997 (DE) ..... 197 54 154

(51) Int. Cl.[7] ..... B65H 29/04

(52) U.S. Cl. ..... 271/204; 474/231; 198/803.7; 198/834

(58) Field of Search ..... 198/644, 681, 198/687, 848, 851, 803.7, 834, 837, 838, 841; 271/204, 277; 474/231, 140, 144

(56) References Cited

U.S. PATENT DOCUMENTS 449,997 A * 4/1891 Brampton ..... 474/231
2,281,938 A * 5/1942 Klaucke ..... 474/231
2,308,651 A * 1/1943 Dreisel ..... 198/681
2,466,639 A * 4/1949 Focke et al. ..... 474/231
3,153,940 A * 10/1964 Patrignani ..... 474/231
3,472,085 A * 10/1969 Rosen ..... 474/231
3,809,390 A * 5/1974 Lenoir ..... 271/204
4,220,240 A * 9/1980 Norberg et al. ..... 198/681
4,276,978 A * 7/1981 Deguchi et al. ..... 271/204
4,351,637 A * 9/1982 Dixon ..... 198/838
4,446,784 A * 5/1984 Gurak et al. ..... 474/231
4,492,030 A * 1/1985 Beerens
4,850,314 A * 7/1989 Villa
4,879,977 A * 11/1989 Restelli
4,883,159 A * 11/1989 Ketonen
5,289,768 A * 3/1994 Keller ..... 271/277
5,461,851 A * 10/1995 Lehrieder et al. ..... 198/851
5,746,304 A * 5/1998 Hashino et al. ..... 198/851

* cited by examiner

*Primary Examiner*—Robert P. Olszewski
*Assistant Examiner*—Steven B. McAllister
(74) *Attorney, Agent, or Firm*—Laurence A. Greenberg; Werner H. Stemer; Ralph E. Locher

(57) ABSTRACT

A conveyor chain for a gripper system-bearing chain conveyor of a printing press, the conveyor chain having standard chain links and special chain links, both types of which are formed by link pins carrying chain rollers, and chain plates articulatedly connecting the link pins to one another, the special chain links serving to connect the conveyor chain to the gripper system, includes two row-wise arranged chain-roller sections rotatable independently of one another, the chain-roller sections being disposed on the link pins of at least the special chain links; and a sheet-processing printing press with a chain conveyor including the conveyor chain.

5 Claims, 4 Drawing Sheets

CONVEYOR CHAIN FOR A GRIPPER SYSTEM-BEARING CHAIN CONVEYOR OF A PRINTING PRESS

BACKGROUND OF THE INVENTION

Field of the Invention

The invention relates to a conveyor chain for a gripper system-bearing chain conveyor of a printing press, the conveyor chain having standard chain links and special chain links, both types of which are formed by link pins carrying chain rollers, and chain plates articulatedly connecting the link pins to one another, the special chain links serving to connect the conveyor chain to the gripper system, and relates as well to a sheet-processing printing press with a chain conveyor having gripper bars for transporting sheets, the gripper bars being borne by revolving conveyor chains when operating.

During practical usage of a conveyor chain of the aforementioned type in a chain conveyor of a printing press, wherein the chain conveyor bears a gripper system, the conveyor chain, when operating, passes through a closed chain path having at least two turning regions. In this regard, at least one of the turning regions is realized by a sprocket which meshes with the conveyor chain and drives the latter.

The gripper system is formed by gripper bars bearing sheet grippers. These bars extend in the longitudinal direction of the gripper system, transversely to the aforementioned chain path. At first ends of the gripper bars, the latter are connected to a first conveyor chain of the type mentioned at the introduction hereto, and at second ends of the gripper bars, the latter are connected to a second conveyor chain of the type mentioned at the introduction hereto. The chain rollers are guided by inner and outer chain guides, of which, depending upon the requirements as to the stability of the chain guides, the inner ones are interrupted within part of the turning region formed by the sprocket, or have a contour which runs within the root circle of the sprocket. These inner chain guides have end sections which run laterally of the sprocket and along which the chain rollers are gradually brought by the chain guides up to the root circle of the sprocket and lifted out of the latter, respectively. The end sections have a guide surface for the chain rollers which is narrowed at least by the extent of thickness of the sprocket teeth.

Chain conveyors constructed in this manner have become known heretofore, for example, from the printing presses marketed under the model designation SM102 by Heidelberg Druckmaschinen A. G., the German corporate assignee of the instant application. The chain conveyors serve herein for accepting a respective sheet from an impression cylinder and further transporting the sheet to a pile station, the conveyor chain being prevented, in particular, from entering the toothing of the sprocket with a jolt, by configuring the course of the end sections of the inner chain guides so that a respective chain roller entering a tooth gap in the sprocket reaches the root circle of the latter only after tracing a relatively large angle of rotation of the sprocket, and is subsequently lifted by the narrowed guide surface of the end sections.

The advantage that the conveyor chain is infed for the most part free of jolting into the toothing of the sprocket, due to the described configuration of the end sections of the inner chain guides, is disadvantageously opposed, however, by the fact that, in particular, the aforementioned end sections are responsible for wearing of the chain conveyor, which is based on the fact that, along a specific travel path of these end sections, the guide surface thereof extends concentrically with the root circle of the sprocket and has the curvature of the latter. Along this travel path, it is thus possible for the chain rollers, on the one hand, to contact the guide surface while, on the other hand, the engagement in the toothing of the sprocket counteracts any rolling of the chain rollers on the guide surface.

In a largely load-free state, the thereat occurring frictional conditions would be relatively nonproblematic. However, forces act upon the chain rollers, above all on those special chain links which bear the gripper bars, and these forces considerably increase the frictional forces by comparison with those on the chain links which are largely load-free. These forces act in an intensified manner, and in a particularly wear-promoting manner, within the aforementioned travel path of the end sections of the chain guides, because this travel path is located in the turning region of the sprocket. Thereat, at the high processing speeds of modern printing presses, which process large-format sheets and for this purpose have gripper bars of relatively great weight, considerable centrifugal forces prevail and, depending upon the position of the center of gravity on the gripper bars, exert upon the special chain links considerable tilting moments, which are reinforced via the chain rollers of the special chain links on the inner and outer chain guides.

If, for example, the further aforementioned transfer of the sheets from an impression cylinder takes place within the aforementioned travel path of the end sections of the chain guides, there will then have been added to the aforementioned centrifugal forces, actuating forces which act upon roller levers of the gripper bars and by which sheet grippers borne by the gripper bars are normally opened counter to the action of spring forces. And, finally, the drive forces transmitted from the sprocket to the conveyor chain act within the aforementioned travel path in a manner which promotes wear, inasmuch as the teeth which are located, respectively, in the infeed region of the sprocket are loaded with the major part of the drive force acting on the part of the sprocket upon the conveyor chain.

SUMMARY OF THE INVENTION

It is accordingly an object of the invention to provide a conveyor chain for a gripper system-bearing chain conveyor of a printing press by which heretofore experienced wear of the chain conveyor is reduced.

With the foregoing and other objects in view, there is provided, in accordance with one aspect of the invention, a conveyor chain for a gripper system-bearing chain conveyor of a printing press, the conveyor chain having standard chain links and special chain links, both types of which are formed by link pins carrying chain rollers, and chain plates articulatedly connecting the link pins to one another, the special chain links serving to connect the conveyor chain to the gripper system, comprising two row-wise arranged chain-roller sections rotatable independently of one another, the chain-roller sections being disposed on the link pins of at least the special chain links.

In accordance with another feature of the invention, one of the chain-roller sections is engageable with a guide surface of a chain guide and is rollable thereon, and the other of the chain-roller sections is engageable in a sprocket and is at a standstill relative thereto.

In accordance with a further aspect of the invention, there is provided a sheet-processing printing press with a chain conveyor having gripper bars for transporting sheets, the gripper bars being borne by revolving conveyor chains when operating, each of the conveyor chains comprising standard chain links and special chain links, both types of which are formed by link pins carrying chain rollers, and chain plates articulatedly connecting the link pins to one another, the special chain links serving to connect the conveyor chain to the gripper system, and two row-wise arranged chain-roller sections rotatable independently of one another, the chain-roller sections being disposed on the link pins of at least the special chain links.

In accordance with a concomitant feature of the invention, one of the chain-roller sections is engageable with a guide surface of a chain guide and is rollable thereon, and the other of the chain-roller sections is engageable in a sprocket of the chain conveyor and is at a standstill relative thereto.

What is achieved thereby is that a first chain-roller section borne by a link pin remains capable of rolling in a turning region realized by a sprocket, while a second chain-roller section borne by the very same link pin remains at a standstill with respect to the sprocket due to the engagement by the second chain-roller section in the sprocket. With respect to the construction of the conveyor chain according to the invention, however, the occurrence of any sliding friction between a chain roller and a guide surface of a chain guide arranged in the region of the sprocket is thereby eliminated to the greatest possible extent. The drastic reduction, which can be achieved in the frictional forces between the conveyor chain and the abovementioned end sections of the chain guides is also accompanied by a corresponding reduction in the thermal loading of the chain conveyor that is equipped with this chain, whereas in the case of conventional chain conveyors in printing presses, at least in the case of heavily loaded chain rollers, thermal expansion of the latter can lead, in particular, to jamming thereof between an inner and an outer chain guide. Furthermore, the construction of the conveyor chain according to the invention counteracts the circumstance, which occurs in the case of conventional chain conveyors, that a chain roller exhibits different wear phenomena along the length thereof, resulting in increased surface pressures between the chain roller and a guide surface therefor on the chain guides.

Other features which are considered as characteristic for the invention are set forth in the appended claims.

Although the invention is illustrated and described herein as embodied in a conveyor chain for a gripper system-bearing chain conveyor of a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Referring now generally to the figures of the drawings, it is noted that, in the case of a chain conveyor of a sheet-processing printing press, a gripper system is conventionally formed by gripper bars, which extend in the longitudinal direction of the gripper system, transversely to the direction in which sheets run through the printing press. A respective end of the gripper bars 2 is connected to a respective conveyor chain disposed in the vicinity of a respective side wall of the printing press and, during operation, passing through a closed chain path which stretches over a plane perpendicular to the longitudinal extent of the gripper bars 2.

Figure 1:
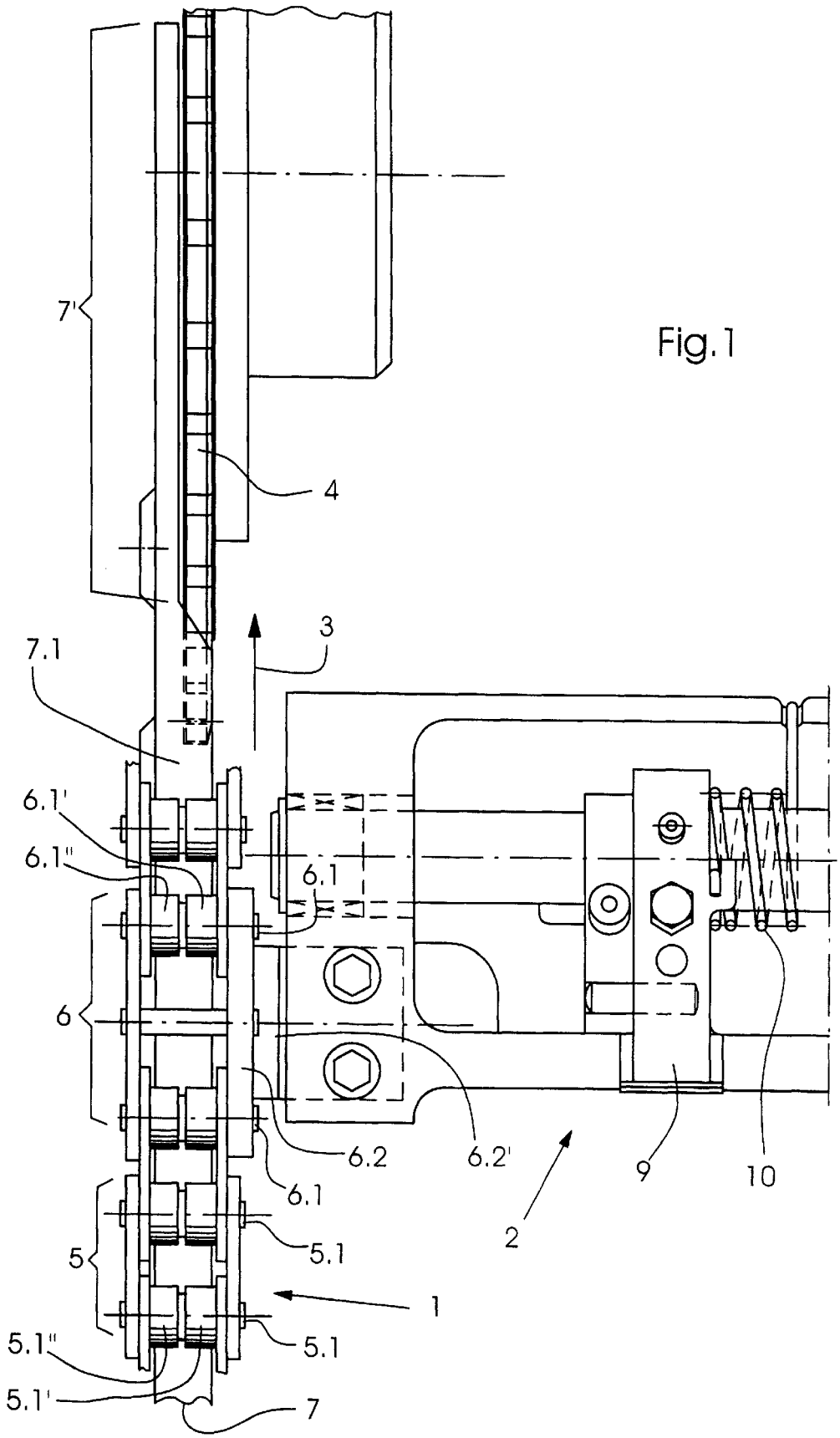
FIG. 1 is a fragmentary plan view of a gripper system-bearing chain conveyor of a printing press and a conveyor chain thereof, in accordance with the invention, the conveyor chain being located in the vicinity of a sprocket deflecting the conveyor chain.

More particularly depicted in a fragmentary view of the chain conveyor in FIG. 1 is an instantaneous position of a conveyor chain 1, a gripper bar 2 fastened to the conveyor chain 1 and revolving therewith in a direction represented by the arrow 3 being shown disposed shortly before or upline of a turning region formed by a sprocket 4.

The conveyor chain 1 is formed as a roller chain and is made up of standard chain links 5 and special chain links 6 which are connected to the gripper bars 2. An example of the connection between the special chain link 6 and the gripper bar 2 is reproduced in FIG. 1, in accordance with which, a chain plate 6.2 which faces the gripper bar 2 and articulatedly connects the link pins 6.1 of the special chain link 6 is formed as an angle plate, a leg 6.2' of the angle plate 6.2 being threadedly secured or screwed to the gripper bar 2. Arranged in a row on the link pins 6.1 of the special chain link 6 and, in accordance with a preferred configuration as illustrated in FIG. 1, arranged in a row on the link pins 5.1 of the standard chain links 5, are two chain-roller sections 6.1' and 6.1", and 5.1' and 5.1", respectively, which are rotatable independently of one another.

Figure 2:
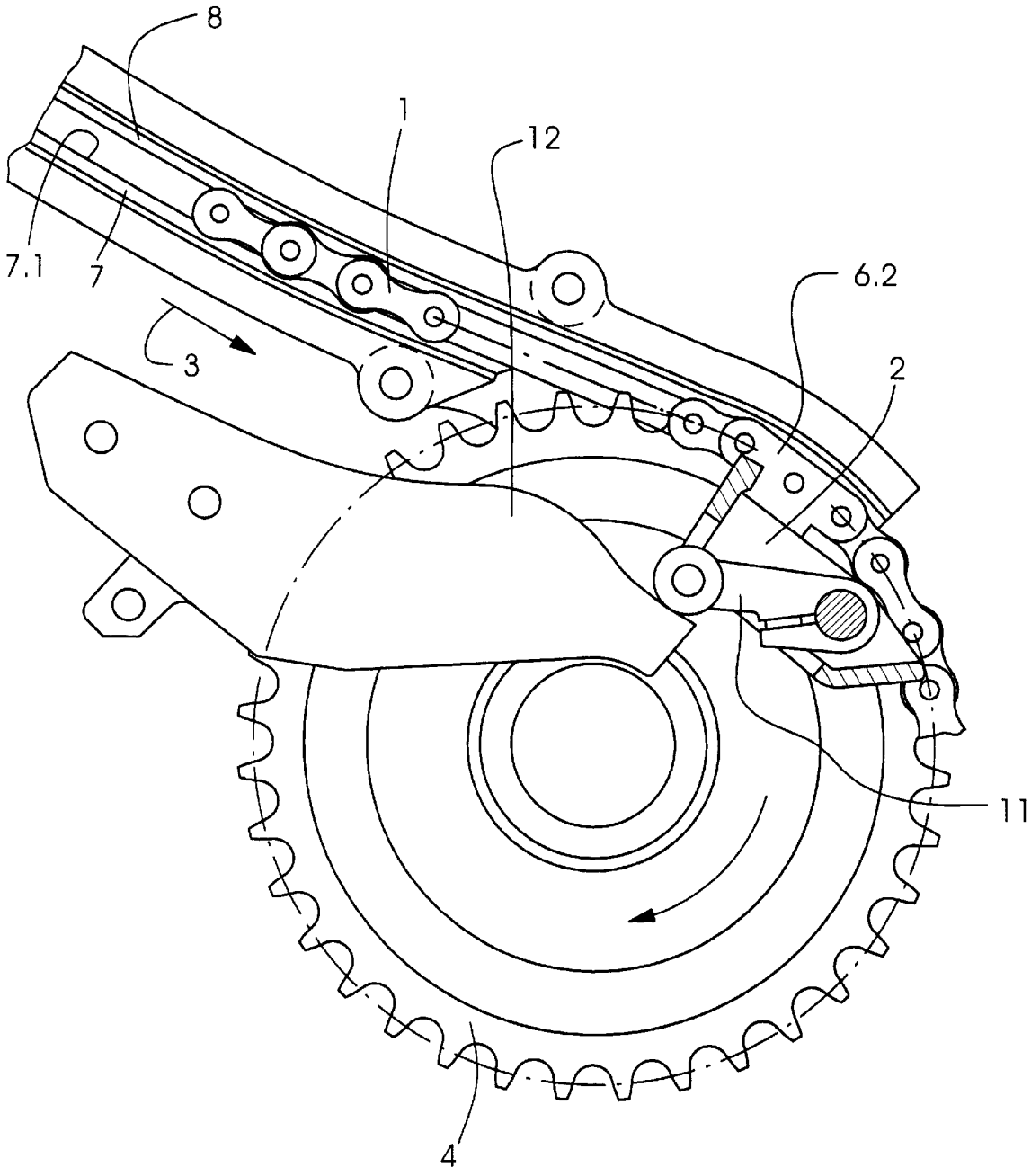
FIG. 2 is a fragmentary front elevational view of the conveyor chain shown in a turning region thereof formed by the sprocket, as well as fragments of an inner and an outer chain guide, with an end section of the inner chain guide extending laterally of the sprocket, and a gripper bar of a gripper system, shown in cross section and connected to the conveyor chain.

The course of the chain path traversed by the conveyor chain 1 is partly determined by the sprocket 4 and partly by an inner chain guide 7 and an outer chain guide 8 (note FIG. 2). Of these, only part of the sprocket 4 and a section of the inner chain guide 7 are reproduced in FIG. 1, of which, according to the mode of illustration selected for FIG. 1, it is possible to see the guide surface 7.1 which is assigned to the chain-roller sections 5.1' and 5.1", and 6.1' and 6.1", respectively.

Figure 3:
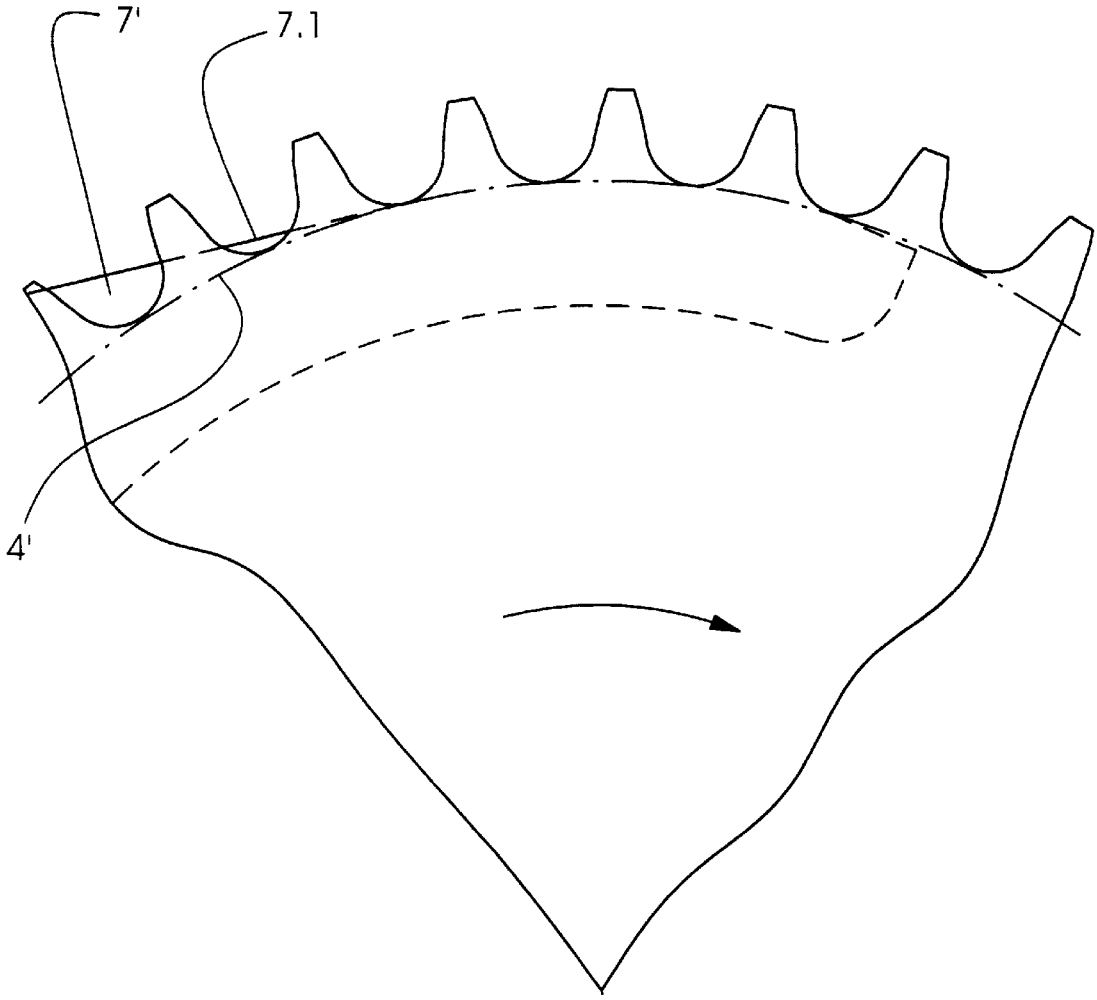
FIG. 3 is an enlarged fragmentary view of FIG. 2 showing the course of a guide surface of the end section of the inner chain guide in relation to a root circle of the sprocket.

Hereinafter, reference is made only to the infeed or entry of the conveyor chain 1 into the toothing of the sprocket 4, because the exit or outlet of the conveyor chain 1 from this toothing occurs in an analogous manner. Accordingly, only a part of the chain guides 7 and 8 that is associated with the entry or infeed region of the sprocket 4 is illustrated in FIG. 2. Therefrom, taken in conjunction with FIG. 1, it is believed to be apparent that the inner chain guide has an end section 7' extending laterally of the sprocket 4. In this end section 7', the width of the guide surface 7.1 is reduced by at least the thickness of the teeth of the sprocket 4. The course of this end section 7' can be seen most clearly from FIG. 3, wherein the assignment of the contour of the end section 7' to the root circle 4' of the sprocket 4 is illustrated.

By lining up respective pairs of chain-roller sections 5.1' and 5.1", and 6.1' and 6.11", which are rotatable independently of one another, on the link pins 5.1 and 6.1, respectively, the possibility exist of dimensioning the former so that the chain-roller sections 5.1" and 6.1", respectively, roll on the narrowed length of the guide surface 7.1 of the end section 7' of the inner chain guide 7, while the chain-roller sections 5.1' and 6.1' are at a standstill with respect to the sprocket 4, in engagement with the toothing thereof, without having any contact with the guide surface 7.1.

In the presented exemplary embodiment of a chain conveyor having a contour of the inner chain guide 7 which, in the turning region of the sprocket 4, runs within the root circle 4' of the sprocket following a section which is concentric with the root circle 4', the chain-roller sections 5.1" and 6.1" lift off from the inner chain guide 7 after the chain-roller sections 5.1' and 6.1', which are respectively associated by being arranged in a row, have entered the toothing of the sprocket 4. A thus superfluous section of the inner chain guide 7 is dispensed with, following the location at which the chain-roller sections 5.1" and 6.1", respectively, lift off from the inner chain guide 7, so that only an end section 7' of the inner chain guide 7 runs laterally of the sprocket 4. It is, of course, also possible to continue the inner chain guide 7, following that section of the guide surface 7.1, which is concentric with the root circle 4' of the sprocket 4, with a contour which runs within the root circle 4' up to or as far as a corresponding concentric section in the exit or outlet region of the conveyor chain 1.

As is apparent from FIG. 2, when using the conveyor chain 1 which is formed in accordance with the information presented hereinabove, the outer chain guide 8 also ends in the region of that end of the inner chain guide 7 which is disposed downline of the travel direction 3. Moreover, FIG. 2 illustrates that use of the conveyor chain 1 wherein, in the turning region, in addition to the centrifugal forces mentioned, actuating forces also occur in order to open sheet grippers 9 as seen in FIG. 1, the grippers 9 being kept closed under the action of a spring arrangement 10 and being opened temporarily by a roller lever 11 when the latter is appropriately deflected by a control cam 12.

In a sheet-processing printing press, the field of use of the conveyor chain that has been explained up to now lies wherever the sheets are not conveyed through the printing press by cylinders or drums. This is, for example, the case between processing stations which are not connected to one another by reversing and/or transfer drums, and in chain deliveries.

Figure 4:
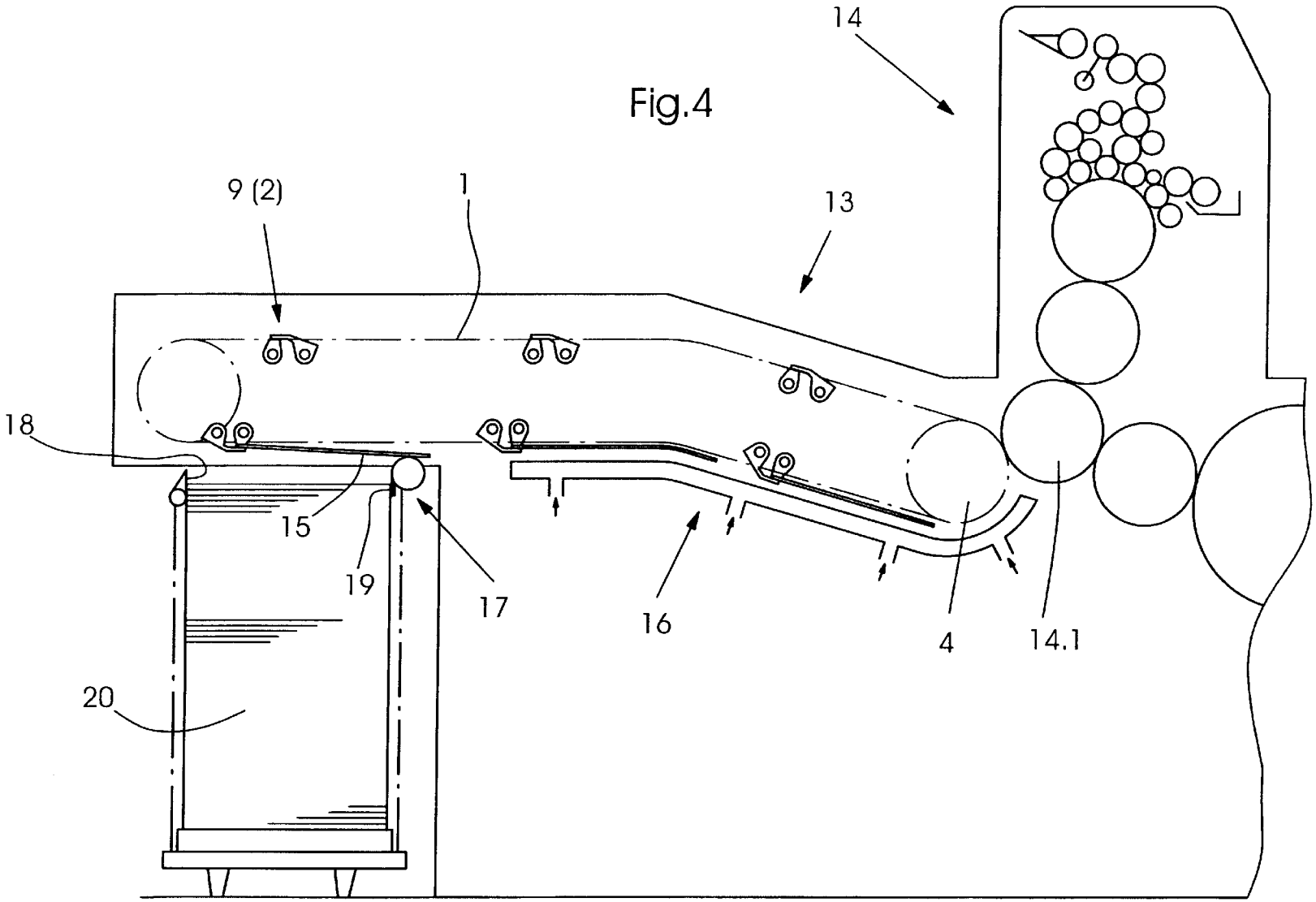
FIG. 4 is a greatly simplified, fragmentary side elevational view of a chain conveyor provided, by way of example, for a delivery of a sheet-processing printing press, and utilizing the conveyor chain according to the invention.

FIG. 4 illustrates the use of the conveyor chain 1 in a delivery 13, which follows a last processing station of a printing press operating in offset process. In the example at hand, this last processing station is a printing unit 14. The gripper bars 2 which form the gripper system and are borne by the conveyor chain 1 are represented in the simplified illustration of FIG. 4 by the sheet grippers 9 carried by the gripper bars. The grippers 9 accept or take over a sheet 15 which is guided by the impression cylinder 14.1, respectively, of the printing unit 14, transport the sheet along a strand or stringer of the conveyor chain 1, i.e., the lower chain strand or stringer in FIG. 4, over a sheet guiding device 16, which forms an air cushion between itself and the sheet 15, and transfer or surrender the sheet to a sheet brake 17, which then releases the sheets 15 after they have been braked to a depositing speed, so that the sheets 15 ultimately strike leading-edge stops 18 on the subsequent travel path thereof and form a sheet pile 20 that is aligned by the leading-edge stops 18 and trailing-edge stops 19 located opposite the latter.

I claim:

1. A conveyor chain assembly, comprising:

a conveyor chain having a length and including:

standard chain links and special chain links, both types of which include link pins, the special chain links for connecting the conveyor chain to a component, chain plates articulatedly connecting the link pins to one another, a first series of a plurality of first chain-roller sections disposed along the length of the conveyor chain;

and a second series of a plurality of second chain-roller sections disposed along the length of the conveyor chain;

each one of said link pins of said special chain links including one of said plurality of said first chain-roller sections and one of said plurality of said second chain-roller sections, said one of said plurality of said first chain-roller sections and said one of said plurality of said second chain-roller sections being rotatable independently from each other;

a drive sprocket including a toothed rim having a width; and an inner chain guide including a guide surface with a deflection region having a width, said guide surface including a portion outside of said deflection region having a width, said width of said deflection region being reduced from said width of said portion outside of said deflection region by at least said width of said toothed rim;

said portion outside of said deflection region supporting said first series of said plurality of said first chain-roller sections and said second series of said plurality of said second chain-roller sections, said deflection region supporting only one series of chain-roller sections selected from the group consisting of said first series of said plurality of said first chain-roller sections and said second series of said plurality of said second chain-roller sections.

2. The conveyor chain assembly according to claim 1, wherein said first series of said plurality of said first chain-roller sections is engageable with said guide surface and is rollable thereon, and said second series of said plurality of said second chain-roller sections is engageable in said drive sprocket and is at a standstill relative thereto while engaged.

3. A sheet-processing printing press with a chain conveyor having gripper bars for transporting sheets, the gripper bars being borne by conveyor chain assemblies, each of the conveyor chain assemblies comprising:

a conveyor chain having a length and including:

standard chain links and special chain links, both types of which include link pins, the special chain links for connecting the conveyor chain to a component, chain plates articulatedly connecting the link pins to one another, a first series of a plurality of first chain-roller sections disposed along the length of the conveyor chain; and a second series of a plurality of second chain-roller sections disposed along the length of the conveyor chain;

each one of said link pins of said special chain links including one of said plurality of said first chain-roller sections and one of said plurality of said second chain-roller sections, said one of said plurality of said first chain-roller sections and said one of said plurality of said second chain-roller sections being rotatable independently from each other;

a drive sprocket including a toothed rim having a width; and an inner chain guide including a guide surface with a deflection region having a width, said guide surface including a portion outside of said deflection region having a width, said width of said deflection region being reduced from said width of said portion outside of said deflection region by at least said width of said toothed rim;

said portion outside of said deflection region supporting said first series of said plurality of said first chain-roller sections and said second series of said plurality of said second chain-roller sections, said deflection region supporting only one series of chain-roller sections selected from the group consisting of said first series of said plurality of said first chain-roller sections and said second series of said plurality of said second chain-roller sections.

4. The sheet processing printing press according to claim 3, wherein said first series of said plurality of said first chain-roller sections is engageable with said guide surface and is rollable thereon, and said second series of said plurality of said second chain-roller sections is engageable in said drive sprocket and is at a standstill relative thereto while engaged.

5. A conveyor chain assembly, comprising:

a conveyor chain having a length and including:

standard chain links and special chain links, both types of which include link pins, the special chain links for connecting the conveyor chain to a component, chain plates articulatedly connecting the link pins to one another, a first series of a plurality of first chain-roller sections disposed along the length of the conveyor chain; and a second series of a plurality of second chain-roller sections disposed along the length of the conveyor chain;

each one of said link pins of said special chain links including one of said plurality of said first chain-roller sections and one of said plurality of said second chain-roller sections, said one of said plurality of said first chain-roller sections and said one of said plurality of said second chain-roller sections being rotatable independently from each other;

drive sprocket including a toothed rim having a width; and an inner chain guide including a guide surface with a deflection region having a width, said guide surface including a portion outside of said deflection region having a width, said width of said deflection region being reduced from said width of said portion outside of said deflection region by at least said width of said toothed rim;

said chain-roller sections having a first axial extension adapted to said width of said guide surface and a second axial extension adapted to said width of said toothed rim of said drive sprocket;

said portion outside of said deflection region supporting said first series of said plurality of said first chain-roller sections and said second series of said plurality of said second chain-roller sections, said deflection region supporting only one series of chain-roller sections selected from the group consisting of said first series of said plurality of said first chain-roller sections and said second series of said plurality of said second chain-roller sections.

* * * * *